US008231508B1

(12) United States Patent
Rousseau

(10) Patent No.: US 8,231,508 B1
(45) Date of Patent: Jul. 31, 2012

(54) BI-DIRECTIONAL EXERCISE DEVICE FOR WRISTS AND FOREARMS

(76) Inventor: Roger Rousseau, Germantown, TN (US)

( * ) Notice: Subject to any disclaimer, the term of this patent is extended or adjusted under 35 U.S.C. 154(b) by 0 days.

(21) Appl. No.: 12/699,748

(22) Filed: Feb. 3, 2010

Related U.S. Application Data

(60) Provisional application No. 61/149,461, filed on Feb. 3, 2009.

(51) Int. Cl.
*A63B 21/00* (2006.01)

(52) U.S. Cl. ..... 482/44; 482/45; 482/46

(58) Field of Classification Search ..... 482/127, 482/126, 121, 44, 45, 46, 49
See application file for complete search history.

(56) References Cited

U.S. PATENT DOCUMENTS 5,046,727 A * 9/1991 Wilkinson et al. ..... 482/45
5,690,598 A * 11/1997 Liang ..... 482/127

* cited by examiner

*Primary Examiner* — Jerome W Donnelly
(74) *Attorney, Agent, or Firm* — Wyatt, Tarrant & Combs, LLP; William S. Parks

(57) ABSTRACT

A novel exercise device that permits opposing movement of two distinct substantially equal length end portions around a single axis is provided. Such a device permits a user to exercise the muscles in his or her wrists and forearms through rotational movement in opposing directions simultaneously. The novel device includes a tightening means to adjust the resistance of the two end portions in order to accord the user different levels of tension for selected levels of muscle workout. As such, the inventive device, being of a very small construction is easy to store and transport, further permitting the user the capability of undertaking such an exercise regimen in any selected location. A method of utilizing such a unique, small-construction exercise device is encompassed within this invention also.

16 Claims, 1 Drawing Sheet

BI-DIRECTIONAL EXERCISE DEVICE FOR WRISTS AND FOREARMS

CROSS-REFERENCE TO RELATED APPLICATION

This application claims priority to Provisional Application 61/149,461, filed on Feb. 3, 2009, the content of which is incorporated entirely herein by reference.

FIELD OF THE INVENTION

A novel exercise device that permits opposing movement of two distinct substantially equal length end portions around a single axis is provided. Such a device permits a user to exercise the muscles in his or her wrists and forearms through rotational movement in opposing directions simultaneously. The novel device includes a tightening means to adjust the resistance of the two end portions in order to accord the user different levels of tension for selected levels of muscle workout. As such, the inventive device, being of a very small construction is easy to store and transport, further permitting the user the capability of undertaking such an exercise regimen in any selected location. A method of utilizing such a unique, small-construction exercise device is encompassed within this invention also.

BACKGROUND OF THE INVENTION

Exercise devices have been utilized for many years and a continually burgeoning industry exists providing weight lifting and moving systems for the increase in muscle mass and/or muscle toning for a user. Such devices appear to cover nearly all the large muscle groups as well as those of lesser concern. For instance, bench weights are utilized primarily to increase muscle mass in a user's pectoral region as well as biceps and triceps. Leg lifting devices are utilized to do the same for hamstring areas and gastrocnemius (calf) muscles. Of vital importance, as well, are a person's forearms and wrists, whether utilized in terms of improved lifting capability or for everyday functions (as well as for therapeutic purposes to aid in the treatment of or prevention of, as examples, Carpal tunnel problems or arthritic issues). In essence, weight machines have long been provided to improve a person's muscle mass in nearly every area of the body.

Of great difficulty, however, has been the ability to provide weight lifting devices that are portable and/or of limited size to permit utilization in either confined spaces or in any selected location away from a person's home or commonly used gymnasium setting. As either a stress reliever, therapeutic implement, or muscle mass builder, the utilization of any such device in such a manner would be a benefit. The common, typically utilized wrist and/or forearm weight device in the past included a single bar with two strings (or wires) attached to the ends of the single bar. Weights would then be added (substantially the same measure on both ends for even distribution) to the strings with clamps or other secure portions present on the bottom ends of the strings (or wires) to prevent dislodging or unwanted removal of the weights during use. In such a manner, the user could effectively build or tone the wrist and/or forearm muscles by simultaneously rotating the weight-bearing single bar thereby lifting and lowering the weights present on the strings (or wires) attached thereto.

As effective as such an exercise device has proven to be, as alluded to above, the ability to transport such a device to any desired location for further utilization has proven quite difficult. The presence of necessary weights, as well as the bulk of the weights coupled with the other portions of the exercise device has required an increase in storage/transport capability for such a purpose. In addition, the individual components of the typical device required upkeep to ensure every part of the entire device was properly transported and accounted for. For instance, the clamps or other means to prevent removal of the weights during use may become dislodged themselves during storage and/or transport and thus continued monitoring of all such small parts would be required. Likewise, smaller weights, as well as the strings (or wires) would require proper upkeep to ensure proper balance and weight distribution was available at any desired time as well. In other words, the ability to utilize such a typical, cumbersome device has militated against facilitating transport for utilization in locations other than a standard gymnasium, office, or home setting. To date, no improvements have been provided that permit a user to easily store and transport any like device, particularly one that accords the same degree of muscle mass building or toning, and certainly not at any preselected level of resistance.

ADVANTAGES AND SUMMARY OF THE INVENTION

An advantage of the novel exercise device is the ability to transport the entire workout system within a very small space. Another advantage of such a device is the ability to adjust resistance for differing degrees of muscle workout through a simple tensioning means present within one of the end portions of the single bar device, rather than relying upon the removal, adjustment, and/or proper placement of desired weights on the two juxtaposed ends of a typical wrist and forearm exercise device. Yet another advantage of the inventive exercise device is the reliability in obtaining a proper exercise regimen at any desired time and place without need for the presence and/or use of cumbersome hard-to-balance weights.

Accordingly, this invention encompasses a substantially cylindrically shaped device including two ends of substantially similar length and circumference, wherein each of said two ends includes an edge, wherein both of said edges are substantially parallel to one another, wherein said two ends are separated by a pivot point such that at least one of said two ends is rotatable around said pivot point, wherein said pivot point comprises a post, wherein attached to said post is at least one tension adjusting means, and wherein attached to said tension adjusting means and accessible on the edge of one of said ends is a cap that includes means for operating said tension adjusting means. A method of exercising a person's wrist and/or forearm muscles utilizing such a device is encompassed within this invention as well.

Preferably, said device is made from a metal source, although any resilient material that may be pivoted in such a manner may be utilized for such a purpose. As such, steel, aluminum, brass, wood, plastic (such as polyacetal, polystyrene, polycarbonate, high density polyethylene, and any other resilient polymer), rubber (including vulcanized rubber), may constitute the end portions of the device.

Preferably, the cylindrically shaped device is from ½ inch to 2 inches in diameter (from 1.27 to 5.08 centimeters), and most preferably, for ease in use for a typical person's hand size, is about 1 inch (2.54 centimeters) in diameter. The ends are, in essence, handles which provide grip to the user for effective motion rotationally around the pivot point. The pivot point is provided through the presence of a post attached to one of the ends (handles). Such a post is embedded in such a manner to remain stationary within the attached end and is complementary in shape to an opening within the other end (which is actually hollow in design, but is filled with the remaining components of the device when in fully assembled form). Such an opening is thus sufficiently wide to allow for inclusion of an adjustable tensioning means to increase or decrease resistance of the required level of rotational torque around the pivot point itself when the device is fully assembled. The tension adjustments are thus made through the utilization of a screw-type mechanism with access at the edge of the hollow handle.

As alluded to above, the pivot point actually provides a basis for one of the ends to rotate while the other end remains still. However, in actual use, the movement available to the user permits both hands to move in opposite direction of one another with sufficient tension to provide muscle utilization (and apparent degradation) to effectively cause eventual muscle build up subsequent to completion of the exercise.

Also of significance in comparison with the typical single-bar, weight-laden devices of the past, there are no strings or wires needed as there are no weights to be moved, placed, lifted, and/or removed, with the inventive device. The resistance needed to effectuate proper muscle use and build up is provided by a tensioning device rather than actual weight articles. The ability to bypass actual weight use aids immeasurably from a variety of perspectives. Initially, as discussed previously, the ability to actually transport the device to any desired location without need for accounting for every component of a typical wrist and/or forearm exercising mechanism is avoided. Thus, the potentially heavy weights themselves do not need to be carried. As well, the strings (or wires) do not need to be kept intact, and, more importantly, do not require proper measurement to ensure not only that the weights will be prevented from dislodgement during use, but will be properly balanced to assure the user that potential imbalances on one side or another will not require correction (and thus will not cause possible strains or sprains upon use due to compensation for such imbalances). Furthermore, the necessary clamps or other means to keep the weights in place and level do not require upkeep and accounting therefore with the utilization of the inventive device.

The entire inventive device should preferably, though not necessarily, be substantially balanced in terms of its own weight distribution (i.e., the entire mass of the object itself exhibits a substantially even balance on either side of the pivot point) to allow for a reliably balanced workout for the user. The balanced design thus allows for reliable weight distribution to the user to reduce the chances of overcompensation of muscular usage during a workout regimen. As one handle (end) is hollow and the other is not, the weight of the components within the hollow end should thus be sufficient to cause the necessary equal weight distribution.

Likewise, to further provide reliable usage with reduced propensity of the device to slip from the user's grasp, the handles (ends) may be accorded grips, such as rubber sheaths, or diamond knurls, or any other addition or etched result on or within both ends of the device to allow for reliable grasp during use for the user as well. The device is thus used, in general, by grasping the handles (ends) with the palms facing downward. The user then applies an opposing motion, rotating the handles in opposite directions around the pivot point, then reversing such a motion. The initial movement works the inner forearm muscles of one arm, while at the same time working the outer forearm muscles of the other arm; upon reversal, the muscle workings are likewise reversed. The repetitive motion undertaken thus continuously works both sets of muscles of the person's forearms (and wrists as well) to increase the muscle mass thereof.

As noted above, the resistance accorded the user to effectuate differing degrees of muscle tensioning (and thus workout levels) is adjustable within the inventive device through an adjustable tensioning means. This can be accomplished in different manners; however, the preferred manner is to include a thrust bearing within the hollow handle (end) (again, the end that does not include the post, either permanently or removably, attached thereto). The thrust bearing in essence increases resistance upon the post upon tightening through increasing the grip such a bearing applies thereto. A washer, or similar like component, may be present over the post to further generate reliable friction for this purpose (and thus the term "indirectly" is intended to indicate that the thrust bearing may be attached to the post in such a manner), as well as protect the post over long-term use, and a bushing is include over the opposite end of the thrust bearing to permit a screw-type member to be introduced therein. The bushing thus provides a complementary configuration to the screw-type component that allows for screw-type movement and adjustment thereof from the external edge portion of the hollow handle end. The screw-type component may thus be of any design, such as with a standard screwdriver edge, a Phillips edge, an Allen wrench design, and the like. Of importance is the ability of the screw-type mechanism to connect to the thrust bearing through the bushing component, thereby permitting a user the ability to adjust the thrust bearing levels ad, in turn, adjust the tensioning of the overall device as a result. Each of said post, washer, bushing, thrust bearing and cap (preferably a screw-type mechanism) are made from any desired resilient material, as described above. Preferably, brass or steel components are utilized for their reliability, although plastic, wood, and the like, may be utilized as well.

DETAILED DESCRIPTION OF THE DRAWINGS AND PREFERRED EMBODIMENTS

Specific features of the exercise apparatus of the present invention are detailed in the following Detailed Description of the Invention and the accompanying drawings. The preferred modes of the present invention are also described therein. Those having ordinary skill in the exercise device arts will recognize alternative means of accomplishing the objects of the present invention, all of which are deemed to be equivalent to and to fall within the scope of the present invention.

Figure 1:
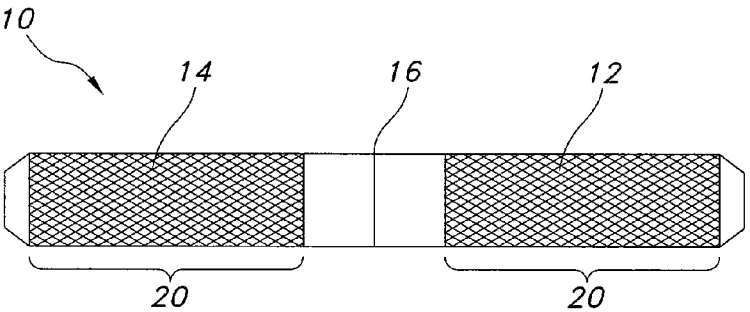
FIG. 1 depicts a side view of one potentially preferred embodiment of the inventive exercise device.

FIG. 1 provides the inventive device 10 having two distinct handles 12, 14, of substantially similar length, and a pivot point 16 around which at least one of said handles 12, 14 may rotate freely. Preferably, the handles 12, 14 are made from anodized aluminum, although any resilient material may be utilized. The handles themselves also preferably include a knurled diamond finish 18, 20 to accord the user an increase in gripping capability during use. Any manner of according grip increase, however, may be utilized for this purpose, as discussed above.

Figure 2:
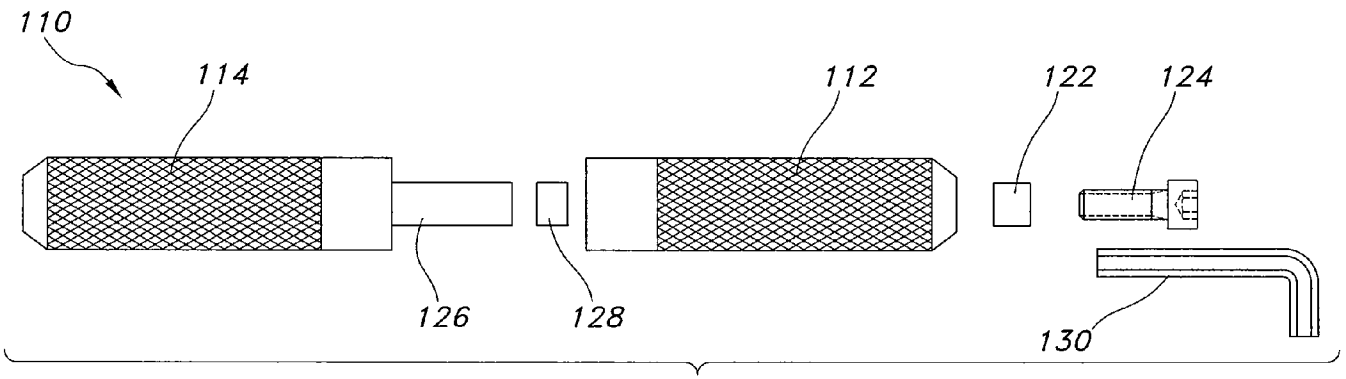
FIG. 2 depicts an exploded view of the inventive device of FIG. 1, including the internal parts present therein.

FIG. 2 thus shows the device 110 when disassembled. A hollow end 112 includes a thrust bearing 122 and an Allen wrench screw 124 to allow for tensioning adjustment around a post 126 and a washer 128. The post 126 is attached to the send end 114 and the hollow end 112 is thus placed over the post 126 and washer 128, as well as the thrust bearing 122

(and bushing, if needed) (not illustrated) to assemble the entire device. An Allen wrench 130 can then be utilized to tighten the Allen wrench screw 124, which in turn adjusts the tension of the thrust bearing 122, which in turn adjusts the resistance of the hollow end 112 in terms of its rotational capability around the pivot point (16 of FIG. 1).

Thus, the singularly contained device (10 of FIG. 1) can be utilized by rotating the two handles (12, 14) around pivot point (16) at any level of desired resistance to accord a workout to a user's forearm and/or wrist muscles. Additionally, this singularly contained device, being of a few pounds, generally, in weight, and of very slight bulk, can easily be transported and utilized in any desired location, be it in a gymnasium, a therapeutic setting, a home, and the like, without the need to transport cumbersome peripheral components.

While the preferred embodiment and best mode of the present invention have been described herein in order to illustrate the principles and applications thereof, it is understood that various modifications or alterations may be made to the present invention without departing from the true scope of the invention set forth in the appended claims.

What I claim is:

1. A substantially cylindrically shaped device including two handles of substantially similar length and circumference and exhibiting a diameter of from ½ inch to 2 inches (1.27 to 5.08 centimeters), wherein a first handle is hollow and includes an open edge, wherein a second handle includes an edge substantially parallel to said open edge of said first handle, wherein said two handles are separated by a pivot point such that at least one of said two ends is rotatable around said pivot point, wherein said pivot point comprises a post, wherein attached directly or indirectly to said post is at least one tensioning means located entirely within the confines of said first handle and including a thrust bearing, and wherein attached to said tensioning means and accessible on said open edge of said first handle is a cap that includes means for operating said tensioning means.

2. The device of claim 1 wherein said handles are comprised of resilient material selected from the group consisting of metal, wood, and plastic.

3. The device of claim 2 wherein said tension adjusting means, said post, and said cap are comprised of resilient material selected from the group consisting of metal, wood, and plastic.

4. The device of claim 2 wherein said handles are made from metal.

5. The device of claim 4 wherein said metal is anodized aluminum.

6. The device of claim 1 wherein the weight distribution is substantially equal on either side of said pivot point.

7. The device of claim 1 wherein said first and second handles both include friction increasing means thereon or therein.

8. The device of claim 4 wherein said first and second handles both include friction increasing means thereon or therein.

9. A method of exercising a person's wrist and/or forearm muscles comprising the steps of a) providing the device of claim 1;
b) having the person place one hand around said first handle and the other hand around said second handle;
c) rotating one hand while grasping said first handle around the pivot point of said device while simultaneously rotating the other hand in the opposite direction around the pivot point of said device while grasping said second handle;
d) reversing the direction of rotation for both hands; and
e) continuing steps "c" and "d" until completion of the desired length of time of said exercising.

10. A method of exercising a person's wrist and/or forearm muscles comprising the steps of a) providing the device of claim 2;
b) having the person place one hand around said first handle and the other hand around said second handle;
c) rotating one hand while grasping said first handle around the pivot point of said device while simultaneously rotating the other hand in the opposite direction around the pivot point of said device while grasping said second handle;
d) reversing the direction of rotation for both hands; and
e) continuing steps "c" and "d" until completion of the desired length of time of said exercising.

11. A method of exercising a person's wrist and/or forearm muscles comprising the steps of a) providing the device of claim 3;
b) having the person place one hand around said first handle and the other hand around said second handle;
c) rotating one hand while grasping said first handle around the pivot point of said device while simultaneously rotating the other hand in the opposite direction around the pivot point of said device while grasping said second handle;
d) reversing the direction of rotation for both hands; and
e) continuing steps "c" and "d" until completion of the desired length of time of said exercising.

12. A method of exercising a person's wrist and/or forearm muscles comprising the steps of a) providing the device of claim 4;
b) having the person place one hand around said first handle and the other hand around said second handle;
c) rotating one hand while grasping said first handle around the pivot point of said device while simultaneously rotating the other hand in the opposite direction around the pivot point of said device while grasping said second handle;
d) reversing the direction of rotation for both hands; and
e) continuing steps "c" and "d" until completion of the desired length of time of said exercising.

13. A method of exercising a person's wrist and/or forearm muscles comprising the steps of a) providing the device of claim 5;
b) having the person place one hand around said first handle and the other hand around said second handle;
c) rotating one hand while grasping said first handle around the pivot point of said device while simultaneously rotating the other hand in the opposite direction around the pivot point of said device while grasping said second handle;
d) reversing the direction of rotation for both hands; and
e) continuing steps "c" and "d" until completion of the desired length of time of said exercising.

14. A method of exercising a person's wrist and/or forearm muscles comprising the steps of a) providing the device of claim 6;
b) having the person place one hand around said first handle and the other hand around said second handle;
c) rotating one hand while grasping said first handle around the pivot point of said device while simultaneously rotating the other hand in the opposite direction around the pivot point of said device while grasping said second handle;
d) reversing the direction of rotation for both hands; and
e) continuing steps "c" and "d" until completion of the desired length of time of said exercising.

15. A method of exercising a person's wrist and/or forearm muscles comprising the steps of a) providing the device of claim 7;

b) having the person place one hand around said first handle and the other hand around said second handle;

c) rotating one hand while grasping said first handle around the pivot point of said device while simultaneously rotating the other hand in the opposite direction around the pivot point of said device while grasping said second handle;

d) reversing the direction of rotation for both hands; and e) continuing steps "c" and "d" until completion of the desired length of time of said exercising.

16. A method of exercising a person's wrist and/or forearm muscles comprising the steps of a) providing the device of claim 8;

b) having the person place one hand around said first handle and the other hand around said second handle;

c) rotating one hand while grasping said first handle around the pivot point of said device while simultaneously rotating the other hand in the opposite direction around the pivot point of said device while grasping said second handle;

d) reversing the direction of rotation for both hands; and e) continuing steps "c" and "d" until completion of the desired length of time of said exercising.

* * * * *